US011011828B2

(12) United States Patent
Park et al.

(10) Patent No.: US 11,011,828 B2
(45) Date of Patent: May 18, 2021

(54) APPARATUS AND METHOD FOR ARRANGING ANTENNAS SUPPORTING MILLIMETER WAVE FREQUENCY BANDS

(71) Applicant: Samsung Electronics Co., Ltd., Gyeonggi-do (KR)

(72) Inventors: Jungmin Park, Gyeonggi-do (KR); Chih Wei Lee, Gyeonggi-do (KR); Chonghwa Seo, Gyeonggi-do (KR); Sungcheol Yoo, Gyeonggi-do (KR); Jongwon Lee, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 41 days.

(21) Appl. No.: 16/383,812

(22) Filed: Apr. 15, 2019

(65) Prior Publication Data

US 2019/0319341 A1 Oct. 17, 2019

(30) Foreign Application Priority Data

Apr. 13, 2018 (KR) ..... 10-2018-0043544

(51) Int. Cl.
*H01Q 1/24* (2006.01)
*H01Q 21/30* (2006.01)
*H01Q 21/06* (2006.01)

(52) U.S. Cl.
CPC ..... *H01Q 1/243* (2013.01); *H01Q 21/062* (2013.01); *H01Q 21/065* (2013.01); *H01Q 21/30* (2013.01)

(58) Field of Classification Search
CPC ..... H01Q 1/243; H01Q 21/30; H01Q 21/062; H01Q 21/065; H01Q 25/002
(Continued)

(56) References Cited

U.S. PATENT DOCUMENTS 7,215,290 B2 5/2007 Cohen
7,705,798 B2 4/2010 Cohen
(Continued)

FOREIGN PATENT DOCUMENTS

EP 2 975 695 A1 1/2016
EP 3113283 A1 1/2017
EP 3734761 A1 11/2020

OTHER PUBLICATIONS

International Search Report dated Jul. 30, 2019.
European Search Report dated Dec. 22, 2020.

*Primary Examiner* — Don P Le
(74) *Attorney, Agent, or Firm* — Cha & Reiter, LLC.

(57) ABSTRACT

Disclosed is an electronic device. The electronic device comprises a housing forming an exterior of the electronic device, and including a front surface, a back surface facing away from the front surface, and a side surface substantially perpendicular to the front surface and the back surface; a first conductive plate positioned towards the back surface having a first antenna array disposed on the first conductive plate, the first antenna array configured to radiate a signal in a first frequency band toward the back surface; a second antenna array connected to the conductive plate, the second antenna array configured to radiate a signal in a second frequency band at least partially different from the first frequency band toward the side surface, and having an antenna element at least partially different from the first antenna array, a second conductive plate positioned towards the side surface having a third antenna array disposed on the second conductive plate, the third antenna array configured to radiate the signal in the second frequency band toward the side surface, and a fourth antenna array connected to the second conductive plate and configured to radiate the signal in the first frequency band toward the back surface.

20 Claims, 12 Drawing Sheets

(58) Field of Classification Search
USPC ..... 343/727
See application file for complete search history.

(56) References Cited

U.S. PATENT DOCUMENTS

| | | | | |
|---|---|---|---|---|
| 8,256,685 | B2 | 9/2012 | Chen et al. | |
| 8,654,032 | B2 | 2/2014 | Yoon et al. | |
| 10,147,997 | B2 | 12/2018 | Kamgaing | |
| 10,381,736 | B2 | 8/2019 | Jung et al. | |
| 2003/0151556 | A1 | 8/2003 | Cohen | |
| 2010/0033393 | A1 | 2/2010 | Myszne et al. | |
| 2010/0035561 | A1 | 2/2010 | Rettig et al. | |
| 2010/0327068 | A1 | 12/2010 | Chen et al. | |
| 2011/0006963 | A1* | 1/2011 | Tani | H01Q 9/0407 343/787 |
| 2011/0175792 | A1 | 7/2011 | Yoon et al. | |
| 2012/0062440 | A1* | 3/2012 | Tasaki | H01Q 21/28 343/841 |
| 2013/0093631 | A1* | 4/2013 | Kodama | H01Q 9/0407 343/702 |
| 2014/0191905 | A1 | 7/2014 | Kamgaing | |
| 2015/0070228 | A1 | 3/2015 | Gu et al. | |
| 2016/0093939 | A1 | 3/2016 | Kim et al. | |
| 2016/0268697 | A1* | 9/2016 | Zhang | H01Q 21/24 |
| 2019/0006751 | A1* | 1/2019 | Chen | H01Q 25/001 |
| 2019/0103680 | A1* | 4/2019 | Liao | H01L 23/66 |
| 2019/0165478 | A1* | 5/2019 | Jo | H01Q 21/062 |
| 2019/0319341 | A1* | 10/2019 | Park | H01Q 21/065 |
| 2020/0227823 | A1* | 7/2020 | Chen | H01Q 21/065 |
| 2020/0381830 | A1 | 12/2020 | Kim et al. | |

* cited by examiner

APPARATUS AND METHOD FOR ARRANGING ANTENNAS SUPPORTING MILLIMETER WAVE FREQUENCY BANDS

CROSS-REFERENCE TO RELATED APPLICATION(S)

This application is based on and claims priority under 35 U.S.C. § 119 to Korean Patent Application No. 10-2018-0043544, filed on Apr. 13, 2018, in the Korean Intellectual Property Office, the disclosure of which is incorporated by reference herein its entirety.

BACKGROUND

1. Field

The present disclosure relates to a device and a method for arranging antennas supporting a millimeter wave frequency band.

2. Description of Related Art

To satisfy increasing demand for wireless data after commercialization of a $4^{th}$ (4G) generation communication system, there is a study of a communication system (e.g., a $5^{th}$ (5G) generation communication system, a pre-5G communication system, or a new radio (NR)) which transmits/receives a signal in a millimeter wave (mmWave) band (e.g., a frequency band having a center frequency of 20 GHz or higher).

The above information is presented as background information only to assist with an understanding of the present disclosure. No determination has been made, and no assertion is made, as to whether any of the above might be applicable as prior art with regard to the present disclosure.

SUMMARY

An electronic device may include a plurality of communication devices for transmitting/receiving a signal in the mmWave band. The plurality of communication devices may support different frequency bands. A communication device may include a first antenna element for radiating a signal toward one side of the electronic device, and a second antenna element for radiating a signal in a direction different from a direction of the signal which the first antenna element radiates. The communication devices may be embedded on one side such as a back surface of the electronic device. In the case where the communication devices are embedded on one side of the electronic device, an issue that a mounting space of the electronic device decreases may occur.

Aspects of the present disclosure are to address at least the above-mentioned problems and/or disadvantages and to provide at least the advantages described below. In certain embodiments of the present disclosure, an electronic device may arrange a plurality of communication devices on a plurality of sides.

In certain embodiments of the present disclosure, the electronic device may radiate signals in the same direction by using antenna elements of the communication devices arranged on different sides.

In certain embodiments, an electronic device comprises a housing forming an exterior of the electronic device, and including a front surface, a back surface facing away from the front surface, and a side surface substantially perpendicular to the front surface and the back surface; a first conductive plate positioned towards the back surface having a first antenna array disposed on the first conductive plate, the first antenna array configured to radiate a signal in a first frequency band toward the back surface; a second antenna array connected to the conductive plate, the second antenna array configured to radiate a signal in a second frequency band at least partially different from the first frequency band toward the side surface, and having an antenna element at least partially different from the first antenna array, a second conductive plate positioned towards the side surface having a third antenna array disposed on the second conductive plate, the third antenna array configured to radiate the signal in the second frequency band toward the side surface, and a fourth antenna array connected to the second conductive plate and configured to radiate the signal in the first frequency band toward the back surface.

In accordance with an aspect of the present disclosure, an electronic device comprises a housing including a first plate forming at least a portion of a front surface of the electronic device, a second plate facing away from the first plate and forming at least a portion of a back surface of the electronic device, and a side member at least partially surrounding a space between the first plate and the second plate; a display positioned within the housing, and visually exposed outside the electronic device through a portion of the first plate; an antenna structure positioned within the housing, wherein the antenna structure includes: at least one first conductive plate facing a first direction, the first direction facing the second plate, and at least one first dipole formed in or on the first communication device between the first conductive plate and a first portion of the side member, when viewed from above the second plate; and at least one second conductive plate facing a second direction, the second direction facing the side member, while electrically connected to the at least one first conductive plate, at least one second dipole antenna formed in or on the second communication device between the second conductive plate and the second plate, when viewed from above the side member, and at least one radio frequency integrated circuit (RFIC) electrically connected with the first conductive plate, the first dipole antenna, the second conductive plate, and the second dipole antenna, and configured to transmit/receive a signal having a frequency between 3 GHz and 100 GHz.

In accordance with another aspect of the present disclosure, an electronic device comprises a housing including a front surface of the electronic device, a back surface facing away from the front surface, and a side surface at least partially surrounding a space between the front surface and the back surface; a first conductive plate positioned on the back surface; a second conductive plate positioned on the side surface; and an interface connecting the first conductive plate and the second conductive plate, a first RFIC disposed on the first conductive plate and configured to transmit a signal in a first frequency band; a first antenna array disposed on the first conductive plate and configured to radiate the signal in the first frequency band toward the back surface; and a second antenna array connected to the first conductive plate and configured to radiate a signal in a second frequency band at least partially different from the first frequency band toward the side surface, and having an antenna element at least partially different from the first antenna array, a second RFIC disposed on the second conductive plate and configured to transmit the signal in the first frequency band; a third antenna array disposed on the second conductive plate and configured to radiate the signal in the second frequency band toward the side surface; and a fourth antenna array connected to the second conductive plate and configured to radiate the signal in the first frequency band toward the back surface.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Hereinafter, certain embodiments of the present disclosure will be described with reference to accompanying drawings. However, those of ordinary skill in the art will recognize that modification, equivalent, and/or alternative on certain embodiments described herein can be variously made without departing from the scope and spirit of the present disclosure. It shall be understood that statements made herein may apply to one embodiment but not all embodiments.

Figure 1:
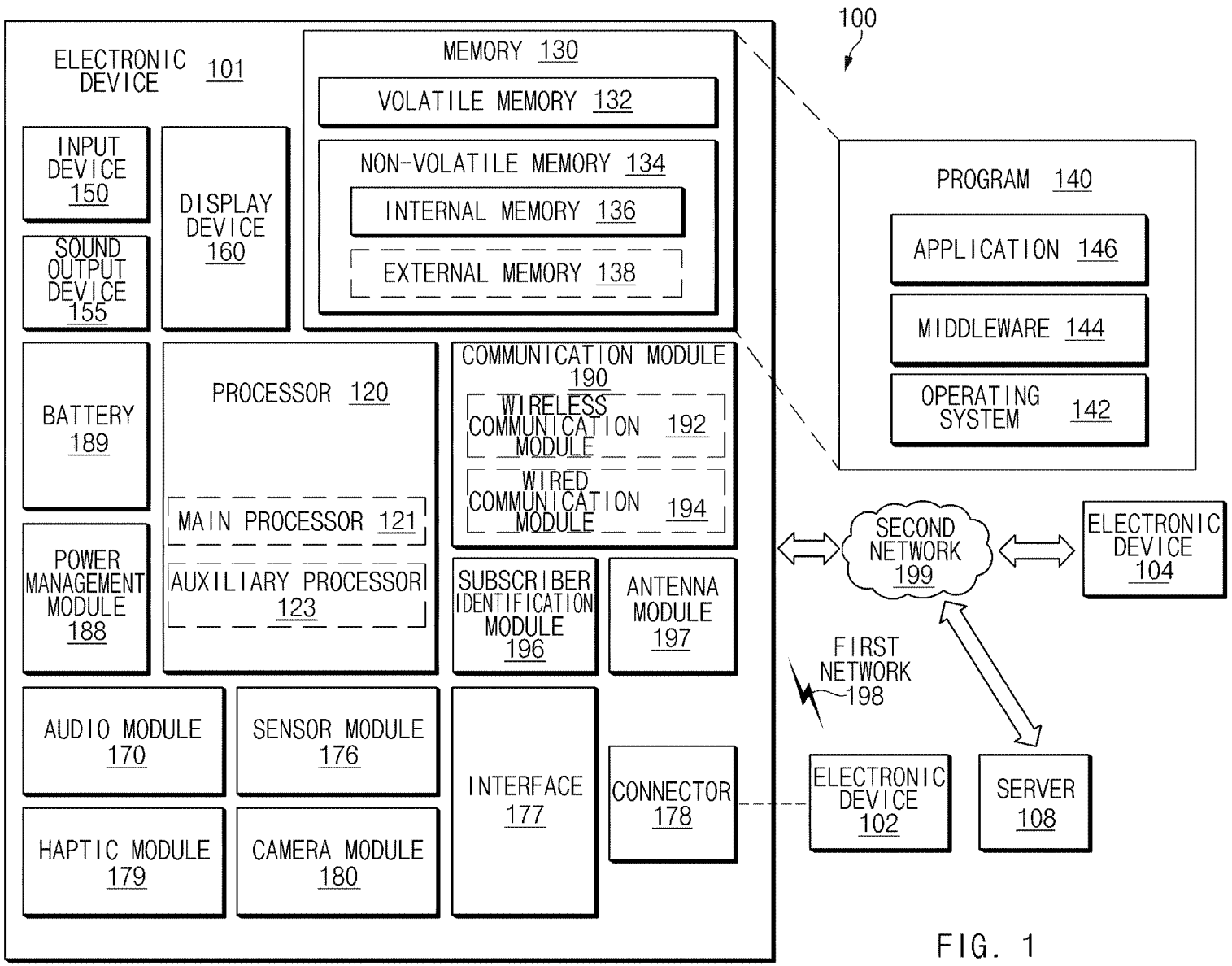
FIG. 1 illustrates a block diagram of an electronic device in a network environment according to certain embodiments.

FIG. 1 is a block diagram illustrating an electronic device 101 in a network environment 100 according to certain embodiments.

Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input device 150, a sound output device 155, a display device 160, an audio module 170, a sensor module 176, an interface 177, a haptic module 179, a camera module 180, a power management module 188, a battery 189, a communication module 190, a subscriber identification module (SIM) 196, or an antenna module 197. In some embodiments, at least one (e.g., the display device 160 or the camera module 180) of the components may be omitted from the electronic device 101, or one or more other components may be added in the electronic device 101. In some embodiments, some of the components may be implemented as single integrated circuitry. For example, the sensor module 176 (e.g., a fingerprint sensor, an iris sensor, or an illuminance sensor) may be implemented as embedded in the display device 160 (e.g., a display).

The processor 120 may execute, for example, software (e.g., a program 140) to control at least one other component (e.g., a hardware or software component) of the electronic device 101 coupled with the processor 120, and may perform various data processing or computation. According to one embodiment, as at least part of the data processing or computation, the processor 120 may load a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), and an auxiliary processor 123 (e.g., a graphics processing unit (GPU), an image signal processor (ISP), a sensor hub processor, or a communication processor (CP)) that is operable independently from, or in conjunction with, the main processor 121. Additionally or alternatively, the auxiliary processor 123 may be adapted to consume less power than the main processor 121, or to be specific to a specified function. The auxiliary processor 123 may be implemented as separate from, or as part of the main processor 121.

The auxiliary processor 123 may control at least some of functions or states related to at least one component (e.g., the display device 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input device 150 may receive a command or data to be used by other component (e.g., the processor 120) of the electronic device 101, from the outside (e.g., a user) of the electronic device 101. The input device 150 may include, for example, a microphone, a mouse, a keyboard, or a digital pen (e.g., a stylus pen).

The sound output device 155 may output sound signals to the outside of the electronic device 101. The sound output device 155 may include, for example, a speaker or a receiver. The speaker may be used for general purposes, such as playing multimedia or playing record, and the receiver may be used for an incoming calls. According to an embodiment, the receiver may be implemented as separate from, or as part of the speaker.

The display device 160 may visually provide information to the outside (e.g., a user) of the electronic device 101. The display device 160 may include, for example, a display, a hologram device, or a projector and control circuitry to control a corresponding one of the display, hologram device, and projector. According to an embodiment, the display device 160 may include touch circuitry adapted to detect a touch, or sensor circuitry (e.g., a pressure sensor) adapted to measure the intensity of force incurred by the touch.

The audio module 170 may convert a sound into an electrical signal and vice versa. According to an embodiment, the audio module 170 may obtain the sound via the input device 150, or output the sound via the sound output device 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an acceleration sensor, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or a movement) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to one embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device via the first network 198 (e.g., a short-range communication network, such as Bluetooth™, wireless-fidelity (Wi-Fi) direct, or infrared data association (IrDA)) or the second network 199 (e.g., a long-range communication network, such as a cellular network, the Internet, or a computer network (e.g., LAN or wide area network (WAN)). These various types of communication modules may be implemented as a single component (e.g., a single chip), or may be implemented as multi components (e.g., multi chips) separate from each other. The wireless communication module 192 may identify and authenticate the electronic device 101 in a communication network, such as the first network 198 or the second network 199, using subscriber information (e.g., international mobile subscriber identity (IMSI)) stored in the subscriber identification module 196.

The antenna module 197 may transmit or receive a signal or power to or from the outside (e.g., the external electronic device) of the electronic device 101. According to an embodiment, the antenna module 197 may include an antenna including a radiating element composed of a conductive material or a conductive pattern formed in or on a substrate (e.g., PCB). According to an embodiment, the antenna module 197 may include a plurality of antennas. In such a case, at least one antenna appropriate for a communication scheme used in the communication network, such as the first network 198 or the second network 199, may be selected, for example, by the communication module 190 (e.g., the wireless communication module 192) from the plurality of antennas. The signal or the power may then be transmitted or received between the communication module 190 and the external electronic device via the selected at least one antenna. According to an embodiment, another component (e.g., a radio frequency integrated circuit (RFIC)) other than the radiating element may be additionally formed as part of the antenna module 197.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. Each of the electronic devices 102 and 104 may be a device of a same type as, or a different type, from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, or client-server computing technology may be used, for example.

The antenna module 197 and the wireless communication module 192 include different kinds of antenna arrays that may radiate signals in the same direction at different locations as will be described below. In certain embodiments, the electronic device 101 may obtain improved antenna gain and directivity.

Figure 2:
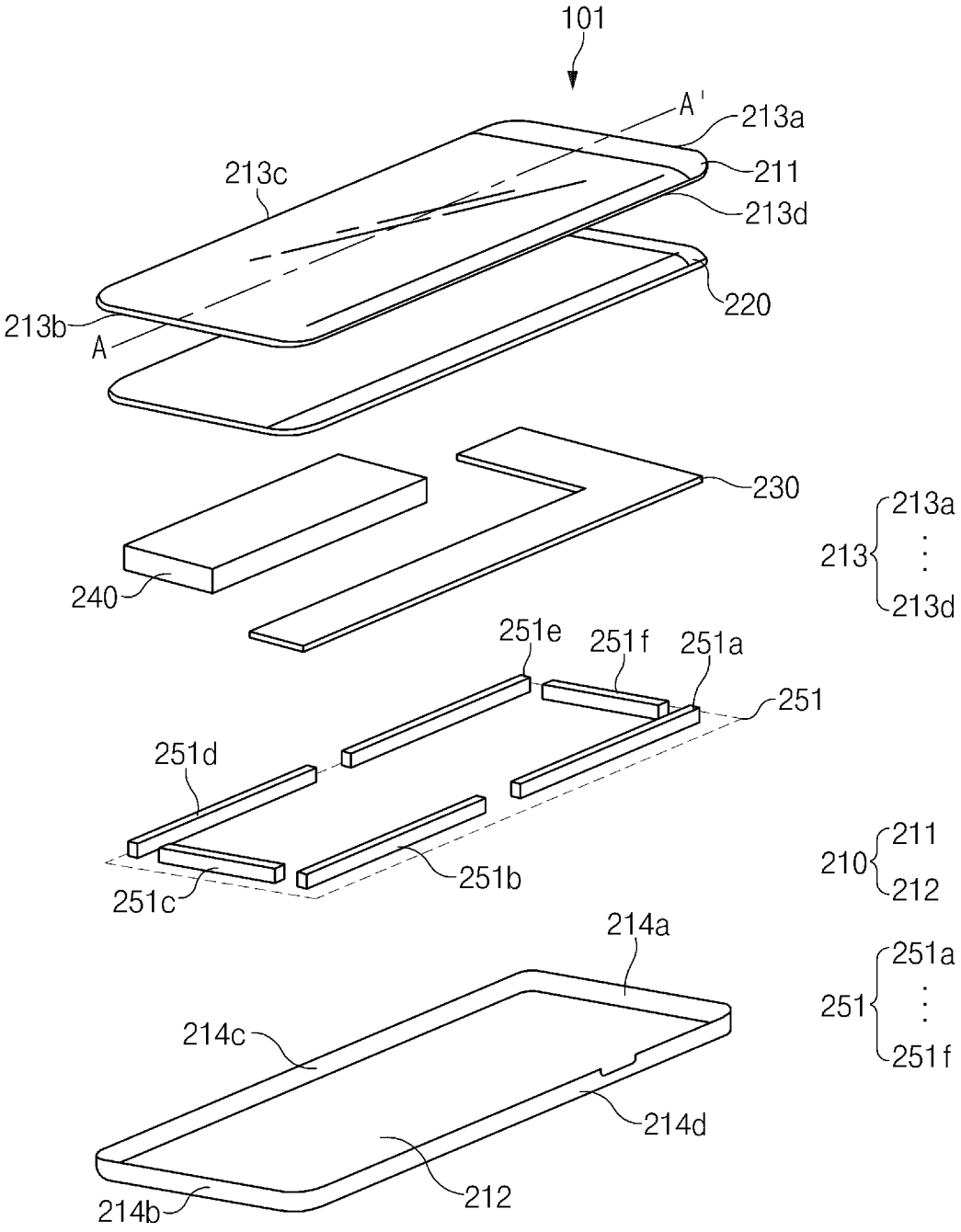
FIG. 2 illustrates an exploded perspective view of an electronic device according to certain embodiments.

FIG. 2 illustrates an exploded perspective view of an electronic device according to certain embodiments.

Referring to FIG. 2, the electronic device 101 (e.g., the electronic device 101 of FIG. 1) may include a cover glass 211, a back cover 212, a display 220, a printed circuit board (PCB) 230, a battery 240, and communication device(s) 251.

The cover glass 211 and the back cover 212 may be coupled with each other to form a housing 210. The housing 210 may form the exterior of the electronic device 101, and may protect internal components of the electronic device 101 from external impact.

The housing 210 may include a front surface, a back surface facing away from the front surface, and a side surface surrounding a space between the front surface and the back surface and perpendicular thereto. A shape of the housing 210 may correspond to at least one of a rectangle (for purposes of this document, a square shall be understood as a particular type of rectangle), substantially a rectangle, a circle, or an ellipse, when viewed from above the front surface. For example, the housing 210 may be in the form of a rectangle or substantially a rectangle (e.g., a rectangle having a curved corner) including a first edge 213*a*, a second edge 213*b* facing away from the first edge 213*a*, a third edge 213*c* connecting one end of the first edge 213*a* and one end of the second edge 213*b*, and a fourth edge 213*d* connecting an opposite end of the first edge 213*a* and an opposite end of the second edge 213*b*, when viewed from above the front surface. According to an embodiment, as illustrated in FIG. 2, the cover glass 211 may form a substantially (within 5% deviation) flat front surface (or a plane) of the electronic device 101 and a side surface extended from the front surface, and the back cover 212 may form the back surface of the electronic device 101 and the side surface 214 extended from the back surface. According to another embodiment, the cover glass 211 may form a substantially flat front surface of the electronic device 101, and the back cover 212 may form the back surface and the side surface of the electronic device 101. In this case, according to an embodiment, the side surface may form a first portion (e.g., the side surface 214) extended from the back surface and a second portion extended from the first portion, and at least a portion of the second portion may be bent in a different direction from the first portion and may be coupled with the front surface (not illustrated).

The side surface 214 may include a first side surface 214*a*, a second side surface 214*b*, a third side surface 214*c* and a fourth side surface 214*d*.

At least a portion of the side surface 214 may be formed of a conductor. For example, the conductor may include a metal material such as aluminum (Al), stainless steel, or the like. In this case the side surface 214 may be formed of, for example, a metal frame which is distinguished from the front surface or the back surface of the housing 210. For example, the housing 210 may include the cover glass 211 corresponding to the front surface, the back cover 212 corresponding to the back surface, and the metal frame corresponding to the side surface.

At least a portion of the cover glass 211 and the back cover 212 may be formed of a dielectric having permittivity of a specified magnitude. For example, permittivity of a dielectric forming the cover glass 211 and permittivity of a dielectric forming the back cover 212 may be identical, or may be at least partially different.

The display 220 (e.g., the display 160 of FIG. 1) may be interposed between the cover glass 211 and the back cover 212. The display 220 may be electrically connected with the printed circuit board (PCB) 230, and may output content (e.g., a text, an image, a video, an icon, a widget, a symbol, or the like) or may receive a touch input (e.g., a touch, a gesture, a hovering, or the like) from the user.

Various electronic parts, various elements, various printed circuits, or the like of the electronic device 101 may be mounted on the printed circuit board 230. For example, an application processor (AP) (e.g., the processor 120 of FIG. 1), a communication processor (e.g., the processor 120 of FIG. 1), or a memory (e.g., the memory 130 of FIG. 1) may be mounted on the printed circuit board 230. In certain embodiments of the present disclosure, the printed circuit board 230 may be referred to as a "first PCB", a "main PCB", a "main board", or a "printed board assembly (PBA)".

The battery 240 (e.g., the battery 189 of FIG. 1) may convert chemical energy and electrical energy bidirectionally. For example, the battery 240 may convert chemical energy to electrical energy and may supply the converted electrical energy to the display 220 and various components or modules mounted on the printed circuit board 230. For another example, the battery 240 may convert and store electrical energy supplied from the outside to chemical energy. According to an embodiment, the printed circuit board 230 may include a power management module (e.g., the power management module 188 of FIG. 1) for managing the charging and discharging of the battery 240.

The communication device 251 may be interposed between the display 220 and the back cover 212. According to an embodiment, the communication device 251 may mean a conductive plate and at least one antenna array electrically connected to the conductive plate for radiating a signal in the mmWave band (e.g., ranging from 3 GHz to 300 GHz). Detailed components included in the communication device 251 will be described with reference to FIG. 4. According to an embodiment, the communication device 251 may include a plurality of communication devices 251*a*, 251*b*, 251*c*, 251*d*, 251*e*, and 251*f* In this case, at least some of the plurality of communication devices 251*a*, 251*b*, 251*c*, 251*d*, 251*e*, and 251*f* may be positioned by the side of the printed circuit board 230 or may be interposed between the printed circuit board 230 and the back cover 212. According to an embodiment, at least some of the plurality of communication devices 251*a*, 251*b*, 251*c*, 251*d*, 251*e*, and 251*f* may be attached to the back cover 212 by a coupling means (e.g., an adhesive or a fastening structure (e.g., a bolt and nut)).

The number, shape, and arrangement of the communication devices 251*a*, 251*b*, 251*c*, 251*d*, 251*e*, and 251*f* are not limited to the example illustrated in FIG. 2, and an embodiment associated with the number, shape, and arrangement of the communication devices 251*a*, 251*b*, 251*c*, 251*d*, 251*e*, and 251*f* will be described with reference to FIGS. 3 to 5. Certain embodiments may include different numbers of communication devices and different configurations.

The electronic device 101 may further include a communication module (not illustrated) (e.g., the communication module 190 of FIG. 1) on the printed circuit board 230. The communication module may include a baseband processor (BP), a radio frequency integrated circuit (RFIC), or an intermediate frequency integrated circuit (IFIC). According to an embodiment, the communication module may be electrically connected with the communication device 251 and may feed a power to the communication device 251. In certain embodiments of the present disclosure, "feeding" may mean an operation in which the communication module applies a current to the communication device 251. In an embodiment, the communication module may communicate with an external device (e.g., the electronic device 102, the electronic device 104, or the server 108 of FIG. 1) through a millimeter wave signal by feeding a power to the communication device 251. The millimeter wave signal may be understood, for example, as a signal, a wavelength is in the order of millimeters, or as a signal having a frequency of a band ranging from 20 GHz to 100 GHz.

Figure 3:
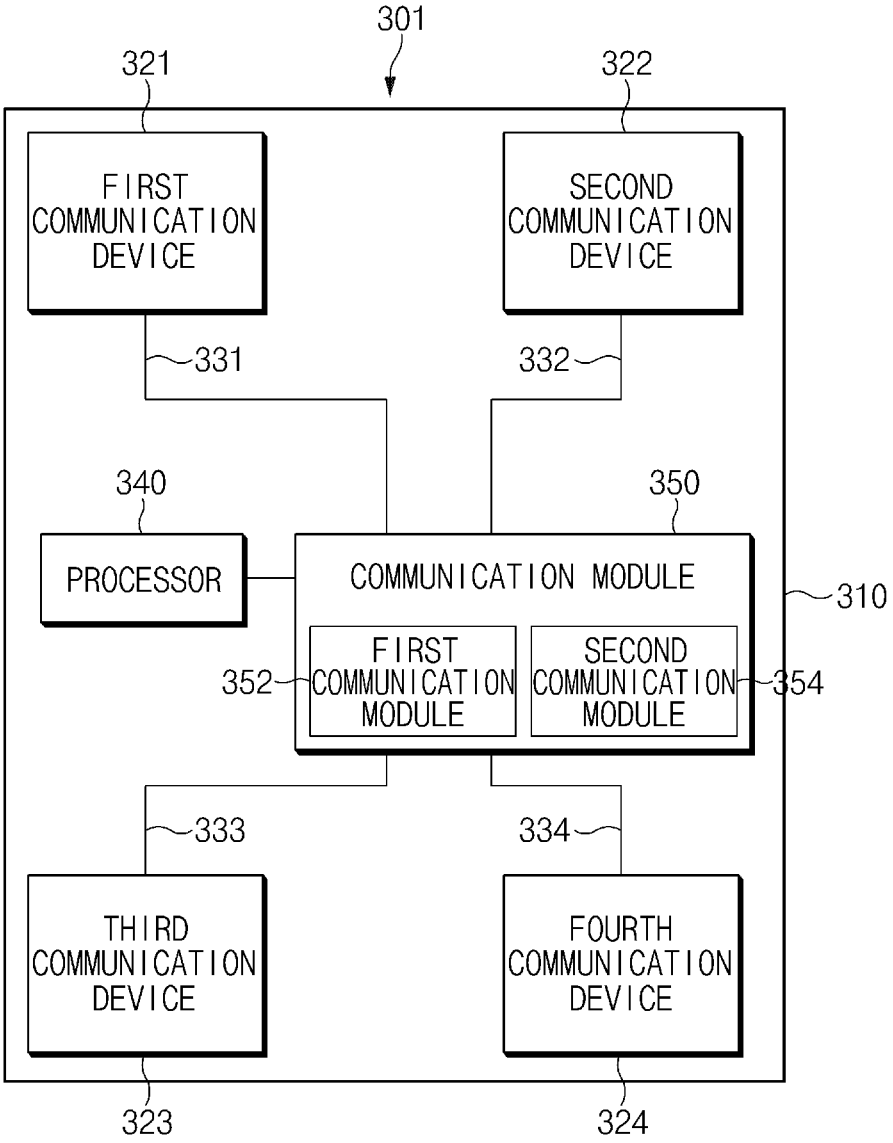
FIG. 3 illustrates a block diagram of an electronic device supporting $5^{th}$ generation (5G) communication according to certain embodiments.

FIG. 3 illustrates a block diagram of an electronic device 301 supporting $5^{th}$ generation (5G) communication according to certain embodiments.

Referring to FIG. 3, the electronic device 301 (e.g., the electronic device 101 of FIG. 2) may include a housing 310 (e.g., the housing 210 of FIG. 2), one or more processors 340 (e.g., the processor 120 of FIG. 1, from hereinafter, "processor" shall be understood to mean one or more processors), a communication module 350 (e.g., the communication module 190 of FIG. 1), a first communication device 321, a second communication device 322, a third communication device 323, a fourth communication device 324 (hereinafter, at least one of the communication devices 251*a*, 251*b*, 251*c*, 251*d*, 251*e*, and 2510, a first conductive line 331, a second conductive line 332, a third conductive line 333, or a fourth conductive line 334.

The housing 310 may protect any other components of the electronic device 301. The housing 310 may include, for example, a front plate, a back plate facing away from the front plate, and a side member (or a metal frame) surrounding a space between the front plate and the back plate. The side member may be attached to the back plate or may be integrally formed with the back plate.

The electronic device 301 may include at least one communication device. For example, the electronic device 301 may include at least one of the first communication device 321, the second communication device 322, the third communication device 323, or the fourth communication device 324.

The processor 340 may include one or more of a central processing unit, an application processor (AP), a graphic processing unit (GPU), an image signal processor of a camera, or a baseband processor (BP) (or a communication processor (CP)). According to an embodiment, the processor 340 may be implemented with a system on chip (SoC) or a system in package (SiP).

The communication module 350 may be electrically connected with at least one communication device by using at least one conductive line. For example, the communication module 350 may be electrically connected with the first communication device 321, the second communication device 322, the third communication device 323, and the fourth communication device 324 by using the first conductive line 331, the second conductive line 332, the third conductive line 333, and the fourth conductive line 334. The communication module 350 may include a BP, an RFIC, or an IFIC.

The communication module 350 may include a processor (e.g., a BP) which is independent of the processor 340 (e.g., an AP). For example, in the case where the processor 340 includes the AP and the communication module 350 includes the BP, the electronic device 301 may further include the RFIC or the IFIC as a separate module (not illustrated). In this case, the RFIC or the IFIC may be electrically connected with the communication module 350, and the RFIC or the IFIC may be electrically connected with the first communication device 321, the second communication device 322, the third communication device 323, and the fourth communication device 324 by using the first conductive line 331, the second conductive line 332, the third conductive line 333, and the fourth conductive line 334. For another example, the BP and the RFIC or IFIC may be integrally formed with the one communication module 350. According to another embodiment, the processor 340 may include the AP and the BP, and the communication module 350 may include the IFIC or the RFIC.

The first conductive line 331, the second conductive line 332, the third conductive line 333, or the fourth conductive line 334 may include, for example, a coaxial cable and/or a flexible printed circuit board (FPCB).

The communication module 350 may include a plurality of communication modules including a first communication module 352 (e.g., a first BP) and a second communication module 354 (e.g., a second BP). The electronic device 301 may further include at least one interface (e.g., an inter processor communication channel) for supporting inter-chip communication between the first communication module 352 (e.g., the first BP) or the second communication module 354 (e.g., the second BP) and the processor 340. The processor 340 and the first communication module 352 or the second communication module 354 may transmit or receive data by using the at least one interface.

The first communication module 352 or the second communication module 354 may provide an interface for performing communication with any other entities. The first communication module 352 may support, for example, wireless communication with regard to a first network (not illustrated). The second communication module 354 may support, for example, wireless communication with regard to a second network (not illustrated).

The first communication module 352 or the second communication module 354 may form one module with the processor 340. For example, the first communication module 352 or the second communication module 354 may be integrally formed with the processor 340.

For another example, the first communication module 352 or the second communication module 354 may be positioned within one chip or may be implemented in the form of an independent chip. According to an embodiment, the processor 340 and at least one BP (e.g., the first communication module 352) may be integrally formed within one chip (e.g., a SoC), and the other BP (e.g., the second communication module 354) may be implemented in the form of an independent chip.

The communication device 321, 322, 323, or 324 may up-convert or down-convert a frequency. For example, the first communication device 321 may up-convert an intermediate frequency (IF) signal received through the first conductive line 331. For another example, the first communication device 321 may down-convert an mmWave signal received through an antenna array (not illustrated), and may transmit the down-converted signal by using the first conductive line 331. According to an embodiment, through the conductive line 331, 332, 333, or 334, the communication device 321, 322, 323, or 324 may transmit a signal directly to the processor 340 or may receive a signal directly from the processor 340. For example, the communication module 350 may be omitted or may be integrated in the processor 340.

For example, the operations of the communication module 350 described in this disclosure may be performed by the processor 340 and/or the communication device 321, 322, 323, or 324.

The first network (not illustrated) or the second network (not illustrated) may correspond to the network 199 of FIG. 1. According to an embodiment, the first network (not illustrated) and the second network (not illustrated) may include a 4G network and a 5G network, respectively. The 4G network may support a long term evolution (LTE) protocol or an LTE-advanced (LTE-A) protocol defined in the 3rd generation partnership project (3GPP). The 5G network may support, for example, a new radio (NR) protocol defined in the 3GPP.

Figure 4:
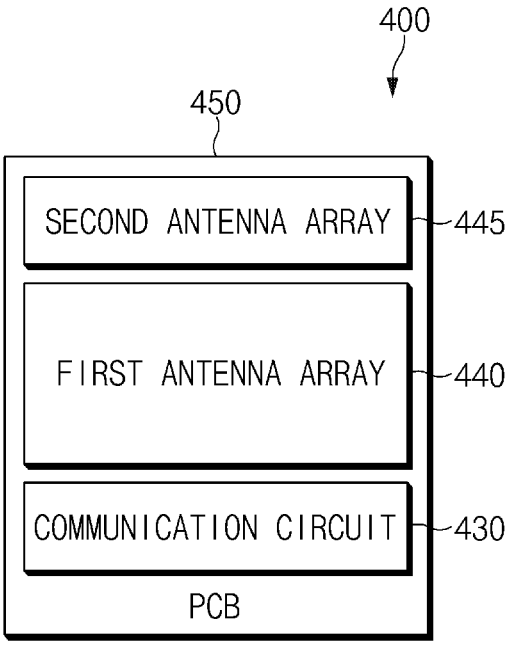
FIG. 4 illustrates a block diagram of a communication device according to certain embodiments.

FIG. 4 illustrates a block diagram of a communication device 400 according to certain embodiments.

Referring to FIG. 4, the communication device 400 (e.g., the first communication device 321, the second communication device 322, the third communication device 323, or the fourth communication device 324 of FIG. 3) may include a conductive plate such as a printed circuit board (PCB) 450, a communication circuit 430 (e.g., an RFIC) positioned on the PCB 450, and one or more antenna arrays (e.g., a first antenna array 440 or a second antenna array 445).

According to an embodiment, the communication circuit 430, the first antenna array 440, or the second antenna array 445 may be positioned on the PCB 450. For example, the first antenna array 440 or the second antenna array 445 may be positioned on a first surface of the PCB 450, and the communication circuit 430 may be positioned on a second surface of the PCB 450. For another example, the first antenna array 440 or the second antenna array 445 may be positioned on the first surface of the PCB 450, and the communication circuit 430 may be positioned on the first surface. The PCB 450 may include a coaxial cable connector or a board to board (B-to-B) connector for electrical connection with any other PCB (e.g., a PCB on which the communication module 350 of FIG. 3 is positioned) by using a transmission line (e.g., the conductive line 331, 332, 333, or 334 of FIG. 3 and/or a coaxial cable). The PCB 450 may be connected to the PCB, on which the communication module 350 is positioned, for example, with a coaxial cable by using a coaxial connector, and the coaxial cable may be used to transmit a radio frequency (RF) signal or a transmit and receive intermediate frequency (IF) signal. For another example, a power or any other control signal may be transmitted through the B-to-B connector.

According to an embodiment, the first antenna array 440 or the second antenna array 445 may include at least one antenna element. The at least one antenna element may include a patch antenna, a loop antenna, or a dipole antenna.

According to an embodiment, the communication circuit 430 may support a radio frequency signal ranging from 3 GHz to 300 GHz. For example, the communication circuit 430 may support a radio frequency signal ranging from 24 GHz to 30 GHz and/or from 37 GHz to 40 GHz. According to an embodiment, the communication circuit 430 may up-convert or down-convert a frequency. For example, the communication circuit 430 included in the first communication device 321 may up-convert an IF signal received from the communication module 350 (or a separate RFIC (not illustrated)) through the first conductive line 331. For another example, the communication circuit 430 may down-convert a millimeter wave (mmWave) signal received through the first antenna array 440 or the second antenna array 445 included in the first communication device 321 and may transmit the down-converted signal to the communication module 350 by using the first conductive line 331.

Figure 5:
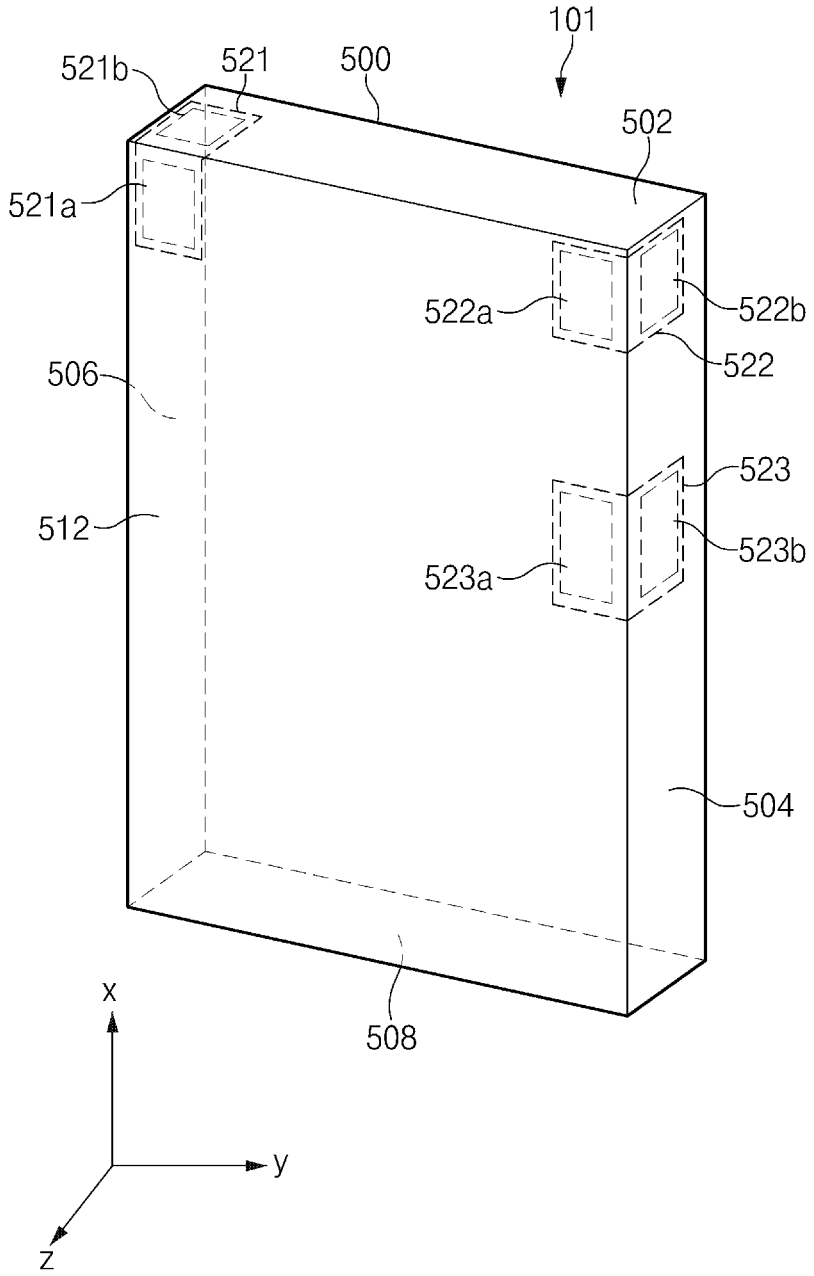
FIG. 5 illustrates a perspective view of an electronic device including a plurality of communication devices on a plurality of sides, according to certain embodiments.

FIG. 5 illustrates a perspective view of the electronic device 101 including a plurality of communication devices on a plurality of sides, according to certain embodiments.

Referring to FIG. 5, the electronic device 101 is shown with conductive plates facing the back plate and side member. The electronic device 101 may include at least one antenna structure 521, 522, or 523 formed with a plurality of conductive plates 521*a* and 521*b*, 522*a* and 522*b*, or 523*a* and 523*b* mounted toward a plurality of different plates within a housing 500 (e.g., the housing 310 of FIG. 3). According to an embodiment, each of the plurality of conductive plates 521*a*, 521*b*, 522*a*, 522*b*, 523*a*, and 523*b* may be positioned substantially parallel (or within 3 degrees of parallel) to a specific plate of the plurality of plates (e.g., a back plate 512 (e.g., the back cover 212 of FIG. 2)) or a side member 502, 504, 506, or 508 (e.g., the second side surface 214 of FIG. 2). Each of the plurality of conductive plates 521*a*, 521*b*, 522*a*, 522*b*, 523*a*, and 523*b* may form a planar structure or a non-planar structure.

For example, the first conductive plate 521*a* included in the antenna structure 521 may be mounted toward the back plate 512 on the left top of the back plate 512 when viewed from above the back plate 512, and the second conductive plate 521*b* may be mounted toward a side member (e.g., the side member 502 or 506) adjacent to a side (e.g., the back plate 512) where the first communication device 521*a* is mounted.

For another example, the first conductive plate 522*a* included in the antenna structure 522 may be mounted toward the back plate 512 on the right top of the back plate 512, and the second conductive plate 522*b* may be mounted toward another side member (e.g., the side member 504 or 502) adjacent to a side (e.g., the back plate 512) where the first conductive plate 522*a* is mounted.

For another example, the first conductive plate 523*a* included in the antenna structure 523 may be mounted toward the right center when viewed from above the back plate 512, and the second conductive plate 523*b* may be mounted toward a side member (e.g., the side member 504) adjacent to a side where the first conductive plate 523*a* is mounted.

The number, arrangement, and shape of antenna structures or communication devices illustrated in FIG. 5 are only an example, and the number, arrangement, and shape of antenna structures or communication devices mounted in the electronic device 101 may be variously changed or modified.

As described above, a part (e.g., the first conductive plate 521*a*, 522*a*, or 523*a*) of a plurality of conductive plate of the electronic device 101 may be mounted toward the back plate 512, and the other(s) (e.g., the second communication device 521*b*, 522*b*, or 523*b*) may be mounted toward a relevant area, thus preventing a mounting space of the electronic device 101 from decreasing.

Figure 6A:
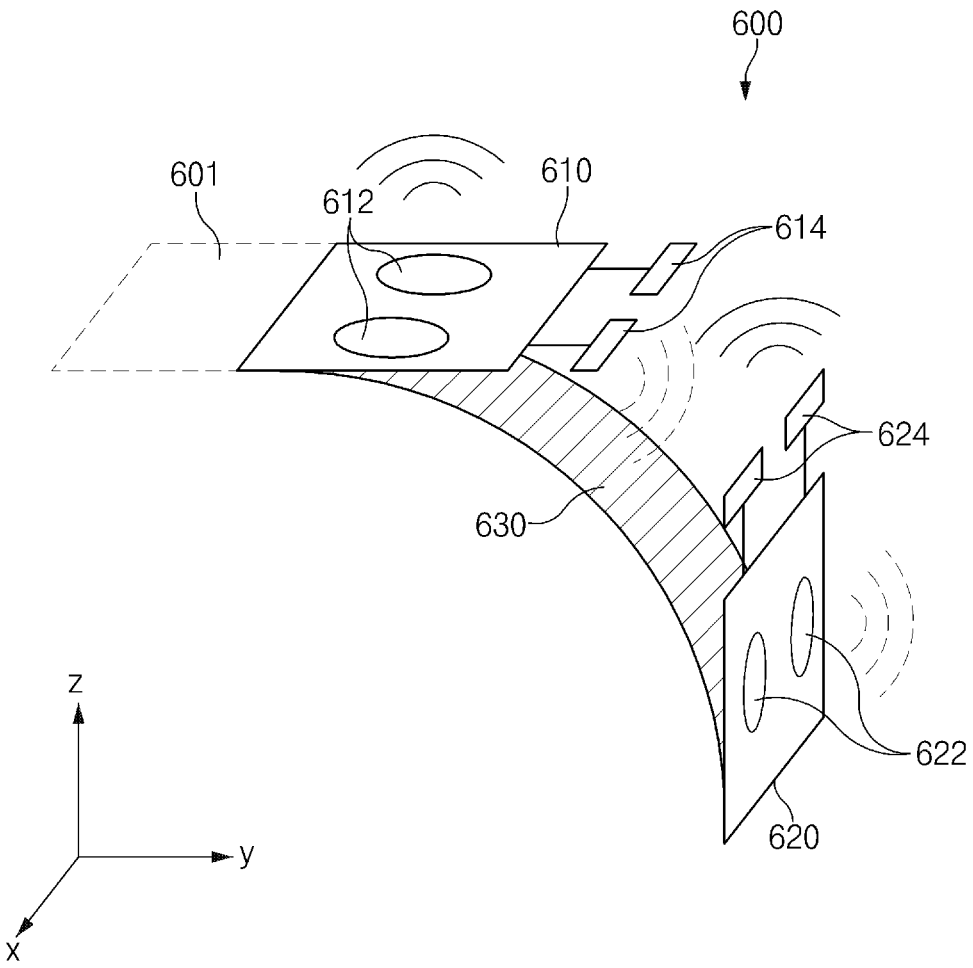
FIG. 6A illustrates an antenna structure including antenna arrays for different frequency bands, according to certain embodiments.

FIG. 6A illustrates an antenna structure 600 including antenna arrays for different frequency bands, according to certain embodiments.

Referring to FIG. 6A, an antenna structure 600 (e.g., the antenna structure 521, 522, or 523 of FIG. 5) may include a conductive plate 610 positioned to face a direction (e.g., a z-axis direction) of a back plate (e.g., the back plate 512 of FIG. 5) within a housing (e.g., the housing 310 of FIG. 3), and a second conductive plate 620 positioned to face a direction (e.g., a y-axis direction) of a side member (e.g., the side member 502, 504, 506, or 508). According to an embodiment, the first conductive plate 610 and the second conductive plate 620 may be substantially (or within 10 degrees) perpendicular to each other.

In the case where the first conductive plate 610 and the second conductive plate 620 included in an antenna structure are positioned only toward the back plate, the antenna structure may require a mounting space for a plurality of antenna arrays, for example, a plurality of first antenna arrays (e.g., a patch antenna array) and a plurality of second antenna arrays (e.g., a dipole antenna array). As illustrated in FIG. 6A, in the case where a conductive plate (e.g., the second conductive plate 620) constituting at least a part of the antenna structure 600 is positioned toward the side member of the electronic device 101, a mounting space (an xy plane area or area 601) associated with the back surface of the electronic device 101 may increase, thus making it possible to mount an electronic part, an element, a communication module (e.g., a short range communication module), or the antenna module 197.

The first conductive plate 610 and the second conductive plate 620 may be connected with an interface 630. The interface 630 may include, for example, a coaxial cable or a flexible printed circuit board (FPCB). A structure of the interface 630 connecting the first conductive plate 610 and the second conductive plate 620 is not limited to an example illustrated in FIG. 6A, and the structure of the interface 630 may be variously changed or modified according to an embodiment illustrated in FIG. 8.

A configuration of the first conductive plate 610 and the second conductive plate 620 may correspond to the communication device 400 of FIG. 4. For example, the first conductive plate 610 may include a first antenna array 612 (e.g., the first antenna array 440 of FIG. 4) including at least one first antenna element, and a second antenna array 614 (e.g., the second antenna array 445 of FIG. 4) including at least one second antenna element.

In an embodiment, the first antenna array 612 may be disposed on the first conductive plate, and the second antenna array 614 may be implemented with a first dipole antenna.

The second conductive plate 620 may include a first antenna array 622 (e.g., the first antenna array 440 of FIG. 4) including at least one first antenna element, and a second antenna array 624 (e.g., the second antenna array 445 of FIG. 4) including at least one second antenna element.

In an embodiment, the first antenna array 622 may be disposed on the second conductive plate 620 with the second antenna array 624 being a second dipole antenna connected to the second conductive plate.

According to an embodiment, different antenna arrays included in the first conductive plate 610 and the second conductive plate 620 may radiate signals in different directions (e.g., directions perpendicular to each other). For example, the first antenna array 612 positioned in the first conductive plate 610 and the second antenna array 624 positioned in the second conductive plate 620 may radiate signals toward the back surface (e.g., in the z-axis direction) of the electronic device 101, and the first antenna array 622 positioned in the second conductive plate 620 and the second antenna array 614 positioned in the first conductive plate 610 may radiate signals toward the side surface (e.g., in the y-axis direction) of the electronic device 101. According to an embodiment, by a third antenna array 616 or 612 of FIG. 6B to be described later, a signal radiated from the first conductive plate 610 or the second conductive plate 620 may have a wide coverage compared to a direction of the back surface or a direction of the side surface.

According to an embodiment, a signal radiated toward the back surface may have a first frequency band, and a signal radiated toward the side surface may have a second frequency band which is at least partially different from the first frequency band. The first frequency band and the second frequency band may mean a frequency band ranging from 3 GHz to 100 GHz. Since different kinds of antenna arrays may radiate signals in the same direction at different locations, the electronic device 101 may obtain improved antenna gain and directivity.

Figure 6B:
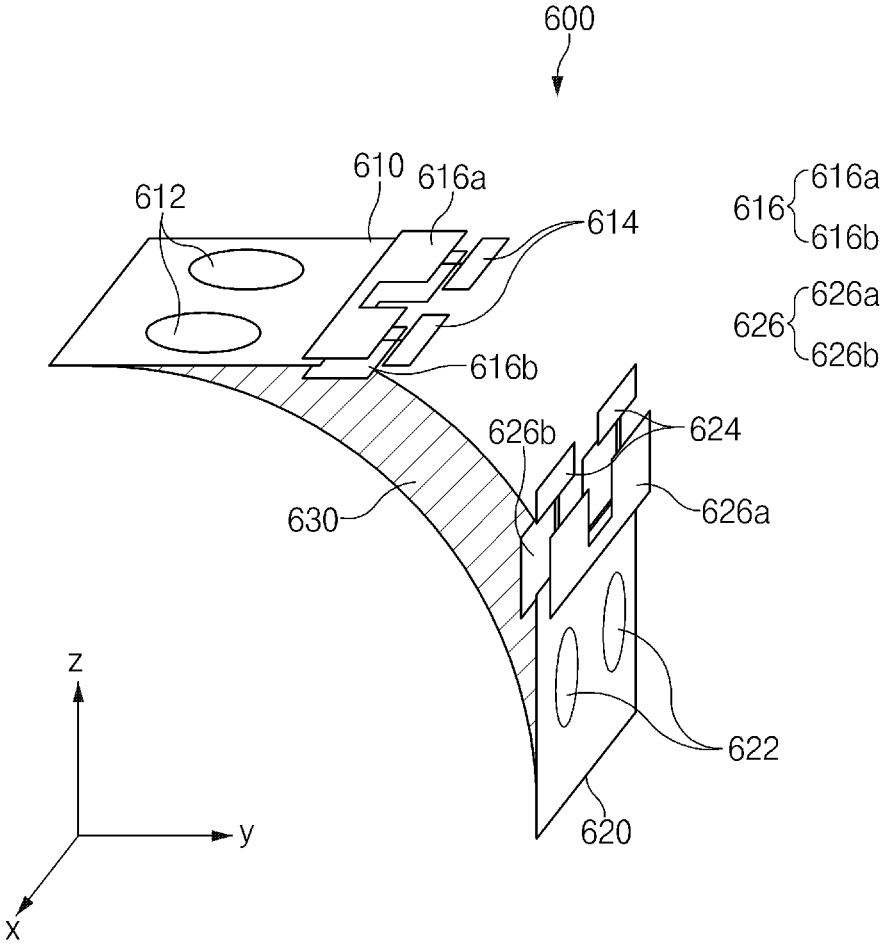
FIG. 6B illustrates an antenna structure including a third antenna array, according to certain embodiments.

FIG. 6B illustrates the antenna structure 600 including a third antenna array, according to certain embodiments.

Referring to FIG. 6B, the antenna structure 600 may include third antenna arrays 616 and 626. The third antenna array 616 may be positioned to face a direction (e.g., the y-axis direction) of a side member (e.g., the side member 502, 504, 506, or 508 of FIG. 5) at the first conductive plate 610, and the third antenna array 626 may be positioned to face a direction (e.g., the z-axis direction) of a back plate (e.g., the back plate 512 of FIG. 5) at the second conductive plate 620.

According to an embodiment, the third antenna array 616 may include a plurality of third antenna elements 616*a* and 616*b* positioned at opposite ends of the second antenna array 614, and the third antenna array 626 may include a plurality of third antenna elements 626*a* and 626*b* positioned at opposite ends of the second antenna array 624. For example, each of the third antenna elements 616*a*, 616*b*, 626*a*, and 626*b* may include a patch antenna.

According to an embodiment, the third antenna arrays 616 and 626 may radiate signals in the same direction as the second antenna arrays 614 and 624. For example, the third antenna array 616 may radiate a signal toward the side surface (e.g., in the y-axis direction) of the electronic device 101, and the third antenna array 626 may radiate a signal toward the back surface (e.g., the z-axis direction) of the electronic device 101.

According to an embodiment, the third antenna array 616 or 626 may radiate a signal in the same direction as the second antenna array 614 or 624; but, since a polarization direction of the signal radiated from the third antenna array 616 or 626 may be at least partially different from a polarization direction of the signal radiated from the second antenna array 614 or 624, propagation directions of the signals may be at least partially different from each other. For example, the signal radiated from the second antenna array 614 may have a polarization direction horizontally (e.g., a xy plane), and the signal radiated from the third antenna array 616 may have a polarization direction vertically (e.g., a zy plane). For another example, the signal radiated from the second antenna array 616 may have a polarization direction horizontally (e.g., an xz plane), and the signal radiated from the third antenna array 626 may have a polarization direction vertically (e.g., a zy plane).

Figure 6C:
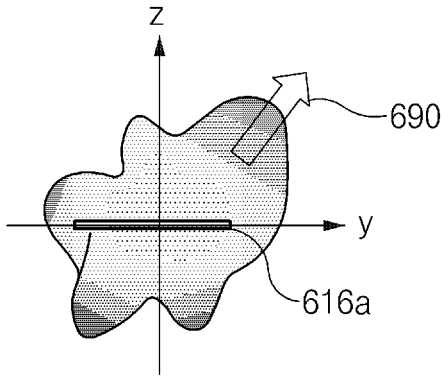
FIG. 6C illustrates a propagation direction of a signal radiated from a third antenna array, according to certain embodiments.
Figure 6C:
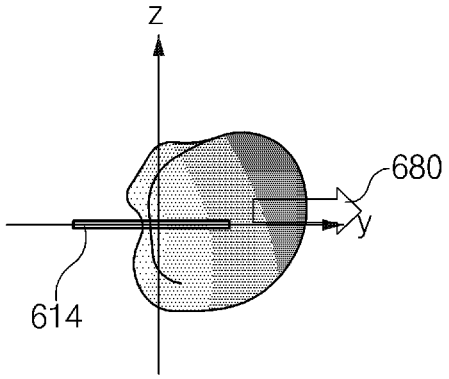

FIG. 6C illustrates a propagation direction of a signal radiated from a third antenna array, according to certain embodiments. FIG. 6C illustrates an example of a propagation direction of a signal radiated from the second antenna array 614 and the third antenna array 616 (e.g., the third antenna element 616*a*) included in the first conductive plate 610 of FIG. 6B, but a similar principle may be applied to the second antenna array 624 and the third antenna array 626 included in the second conductive plate 620.

According to an embodiment, a signal radiated from the second antenna array 614 may be propagated in a direction 680 (e.g., the y-axis direction) of the side surface of the electronic device 101, and a signal radiated from the third antenna element 616*a* may be propagated in a diagonal direction 690 (e.g., a direction of +45 degrees with respect to the y-axis) due to a vertical polarization characteristic. Although not illustrated in FIG. 6C, the signal radiated from the third antenna element 616*b* may be propagated in a direction of −45 degrees with respect to the y-axis by the same principle as the third antenna element 616*a*.

Figure 7A:
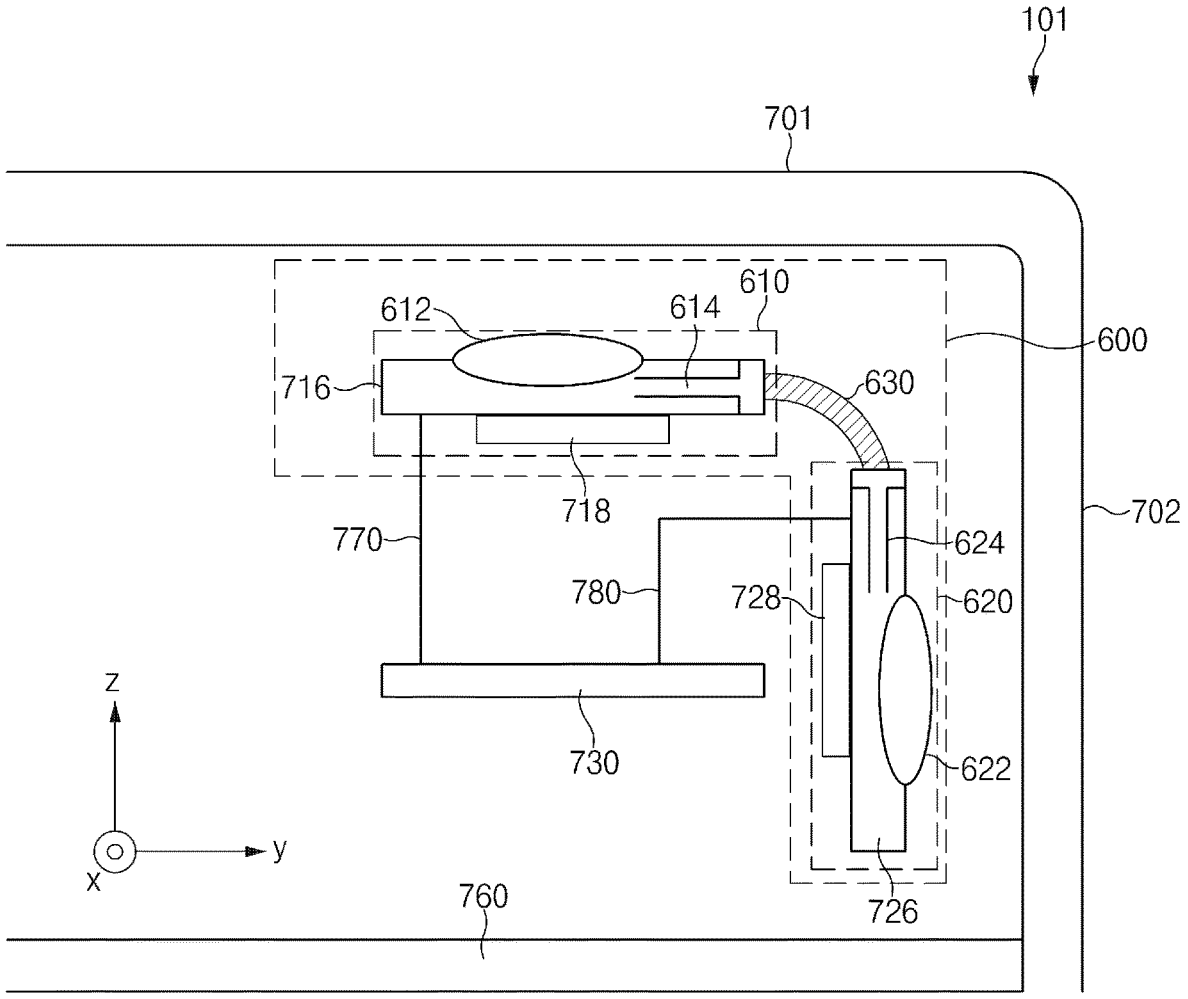
FIG. 7A illustrates a block diagram of a zy plane viewed from above an electronic device including a first communication device and a second communication device, according to certain embodiments.
Figure 7B:
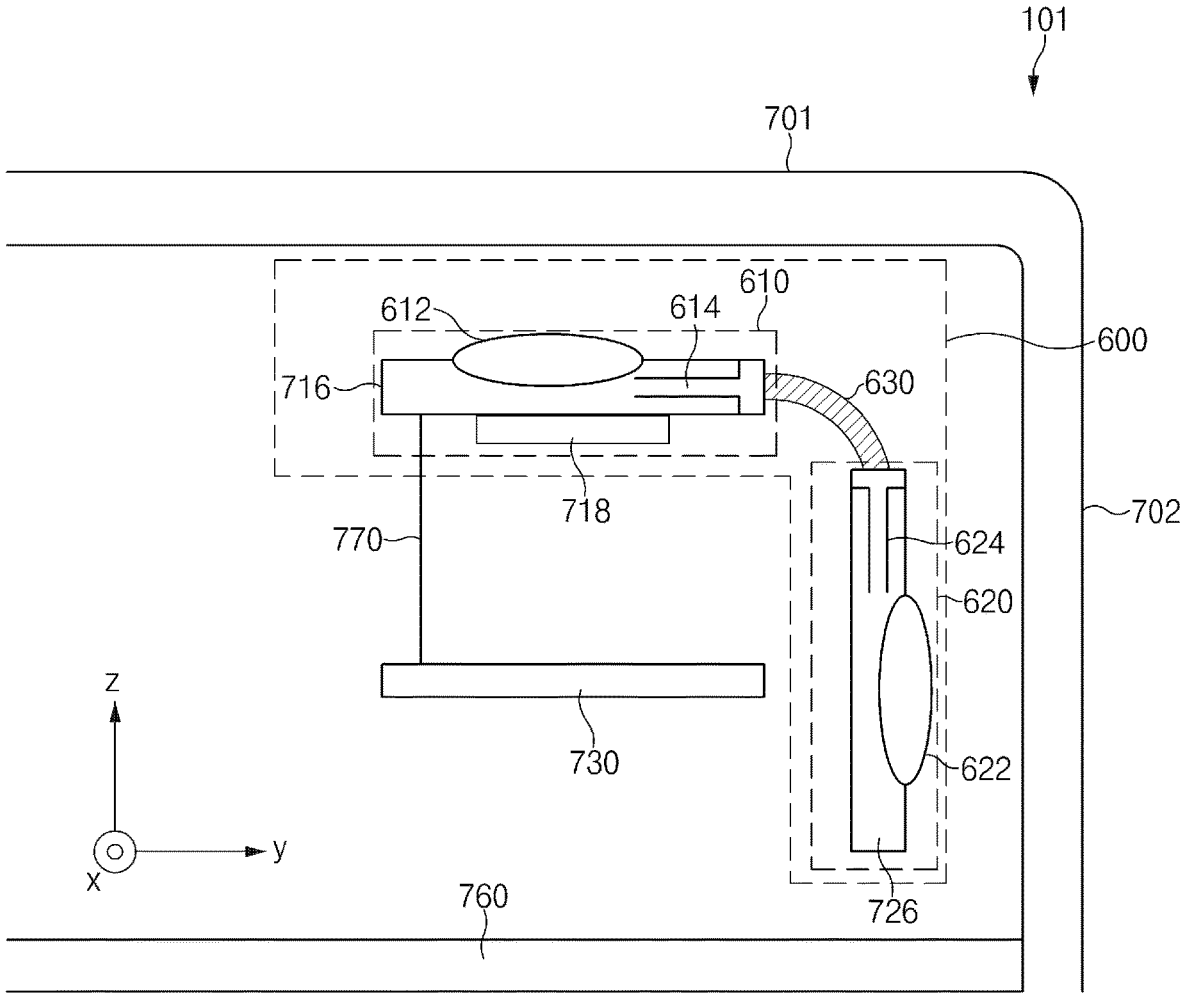
FIG. 7B illustrates a block diagram of a zy plane viewed from above an electronic device which does not include at least one communication circuit, according to certain embodiments.
Figure 7C:
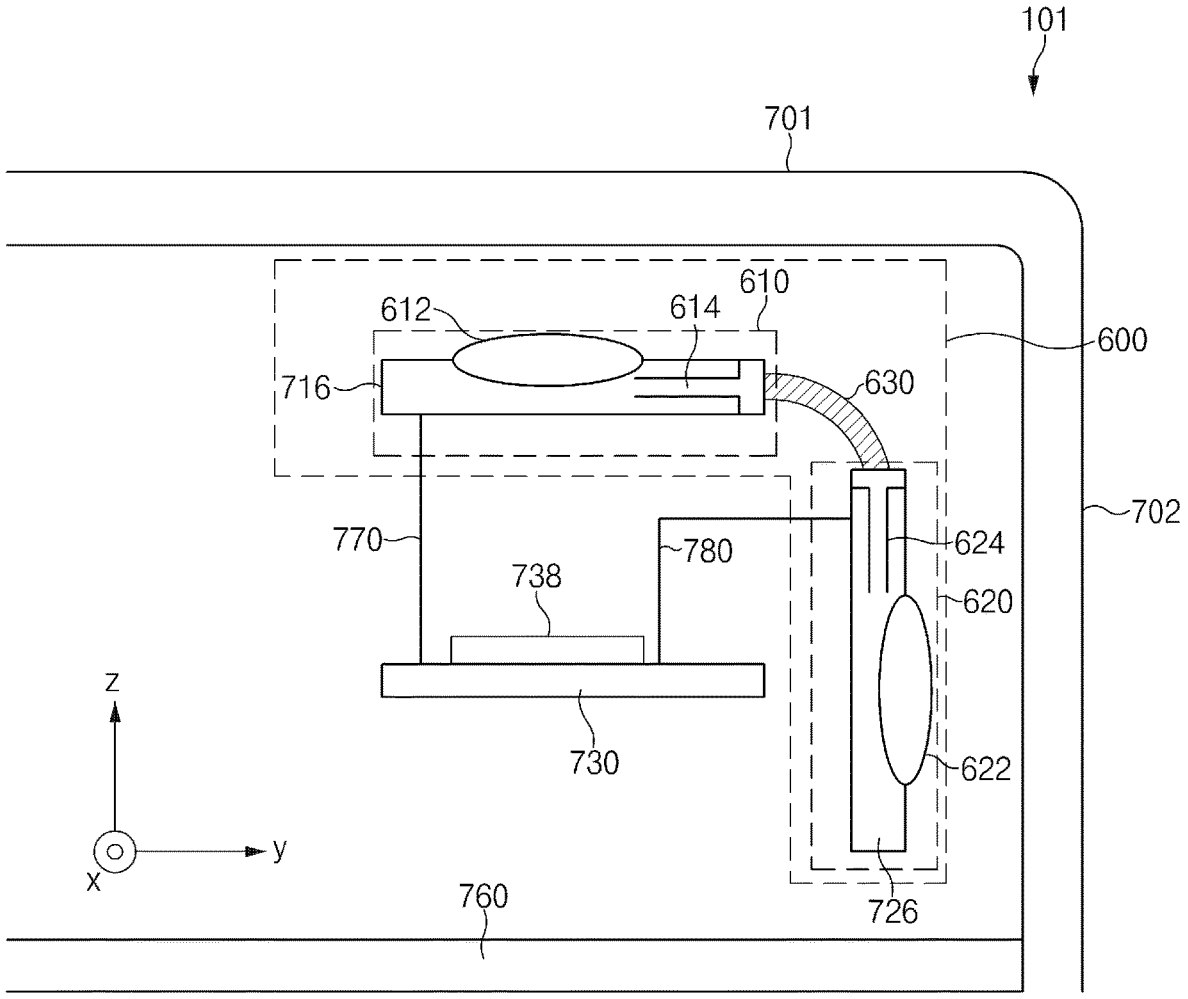
FIG. 7C illustrates a block diagram of a zy plane viewed from above an electronic device including a communication circuit on a third PCB, according to certain embodiments.

FIGS. 7A to 7C illustrate block diagrams of a zy plane viewed from above the electronic device 101 including the first communication device 610 and the second communication device 620, according to certain embodiments.

Referring to FIG. 7A, the electronic device 101 may include a display 760 (e.g., the display 220 of FIG. 2) which is interposed between a back plate 701 (e.g., the back plate 512 of FIG. 5) and a front plate (not illustrated) and is substantially parallel to the back plate 701, within a housing (e.g., the housing 310 of FIG. 3)

According to an embodiment, the electronic device 101 may include the antenna structure 600 positioned between the display 760, the back plate 701, and a side member 702 (e.g., the side member 502, 504, 506, or 508 of FIG. 5) within the housing. The antenna structure 600 may include the first conductive plate 610 and the second conductive plate 620.

According to an embodiment, the first conductive plate 610 may be positioned substantially parallel to the back plate 701, and the second conductive plate 620 may be substantially parallel to the side member 702. According to an embodiment, the first conductive plate 610 or the second conductive plate 620 may be positioned to be spaced from the back plate 701 or the side member 702, or at least a portion of the first conductive plate 610 or the second conductive plate 620 may be attached to the back plate 701 or the side member 702 without a gap by a coupling means (e.g., an adhesive or a fastening structure (e.g., a bolt and nut).

According to an embodiment, the first conductive plate 610 may include a first PCB 716 where the first antenna array 612 (e.g., a first conductive plate) and the second antenna array 614 (e.g., a first dipole antenna) are placed, and the second conductive plate 620 may include a second PCB 726 where the first antenna array 622 (e.g., a second conductive plate) and the second antenna array 624 (e.g., a second dipole antenna) are placed. According to an embodiment, the first PCB 716 and the second PCB 726 may be implemented with one module or may be implemented with separate modules.

According to an embodiment, the electronic device 101 may include a third PCB 730 which is substantially parallel to the first conductive plate 610 and is interposed between the first conductive plate 610 and the display 760. The third PCB 730 may include, for example, a communication module (e.g., the communication module 350 of FIG. 3) (not illustrated). The communication module included in the third PCB 730 may include, for example, at least one of a BP, a CP, an AP, an RFIC, or an IFIC. According to an embodiment, the communication module positioned on the third PCB 730 may be electrically connected with the first conductive plate 610 or the second conductive plate 620 through a conductive line 770 or 780.

One conductive line 770 connecting the first conductive plate 610 and the third PCB 730 is illustrated in FIGS. 7A to 7C, but the first conductive plate 610 and the third PCB 730 may be connected through two or more interfaces. A first interface of interfaces connecting the first conductive plate 610 and the third PCB 730 may be configured to transmit a power signal or a control signal. The first interface may be implemented in the form of a FPCB or an interposer, for example. A second interface, which is different from the first interface, from among the interfaces connecting the first conductive plate 610 and the third PCB 730 may transmit an RF signal. For example, the second interface may include a coaxial cable. For another example, the second interface may be implemented within a PCB. By the same principle as the conductive line 770, the conductive line 780 connecting the second conductive plate 620 and the third PCB 730 may include a first interface transmitting a power signal or a control signal and a second interface transmitting an RF signal.

According to an embodiment, the first conductive plate 610 or the second conductive plate 620 may include at least one communication circuit (e.g., the communication circuit 430 of FIG. 4).

For example, as illustrated in FIG. 7A, the first conductive plate 610 may include a first communication circuit 718 on one surface of the first PCB 716, and the second conductive plate 620 may include a second communication circuit 728 on one surface of the second PCB 726. According to an embodiment, the first communication circuit 718 and the second communication circuit 728 may support different frequency bands.

For example, the first communication circuit 718 may support the first frequency band, and the second communication circuit 728 may support the second frequency band at least partially different from the first frequency band. The electronic device 101 may radiate signals in a plurality of frequency bands by using the first communication circuit 718 and the second communication circuit 728.

According to another embodiment, as illustrated in FIG. 7B, the electronic device 101 may not include one of the first communication circuit 718 and the second communication circuit 728. For example, the electronic device 101 may include only the first communication circuit 718. In this case, an antenna array (e.g., 612 or 614) of the first conductive plate 610 may be connected with the conductive line 770 and the first communication circuit 718. Since the second conductive plate 620 does not include a conductive line (e.g., the conductive line 780 of FIG. 7A), the first communication circuit 718 may transmit the signal in the first frequency band or the second frequency band to the first antenna array 622 or the second antenna array 624 through the interface 630.

According to another embodiment, as illustrated in FIG. 7C, the electronic device 101 may not include the first communication circuit 718 and the second communication circuit 728, and may include a third communication circuit 738 supporting a plurality of frequency bands on one surface of the third PCB 730. The third communication circuit 738 may support a plurality of frequency bands (e.g., the first frequency band and the second frequency band). The third communication circuit 738 may transmit a signal in a radio frequency band to the first conductive plate 610 or the second conductive plate 620 through the conductive line 770 or 780.

According to another embodiment, the electronic device 101 may include the first communication circuit 718, the second communication circuit 728, and the third communication circuit 738. In this case, at least some of the first communication circuit 718, the second communication circuit 728, and the third communication circuit 738 may support the same frequency band or may support different frequency bands.

According to an embodiment, the first conductive plate 610 and the second conductive plate 620 may be connected through the interface 630. The interface 630 may transmit an RF or IF signal to the first conductive plate 610 and the second conductive plate 620. For example, in the case where the electronic device 101 includes both the first communication circuit 718 and the second communication circuit 728, the first communication circuit 718 may transmit the signal in the first frequency band to the second conductive plate 620 through the interface 630, and the second communication circuit 728 may transmit a signal in the second frequency band to the first conductive plate 610 through the interface 630.

For another example, in the case where the electronic device 101 includes only the first communication circuit 718, the first communication circuit 718 may transmit the signal in the first frequency band or a signal in the second frequency band to the second conductive plate 620 through the interface 630. An enlarged view of a structure in which the first conductive plate 610 and the second conductive plate 620 are connected will be described with reference to FIG. 8.

Figure 8:
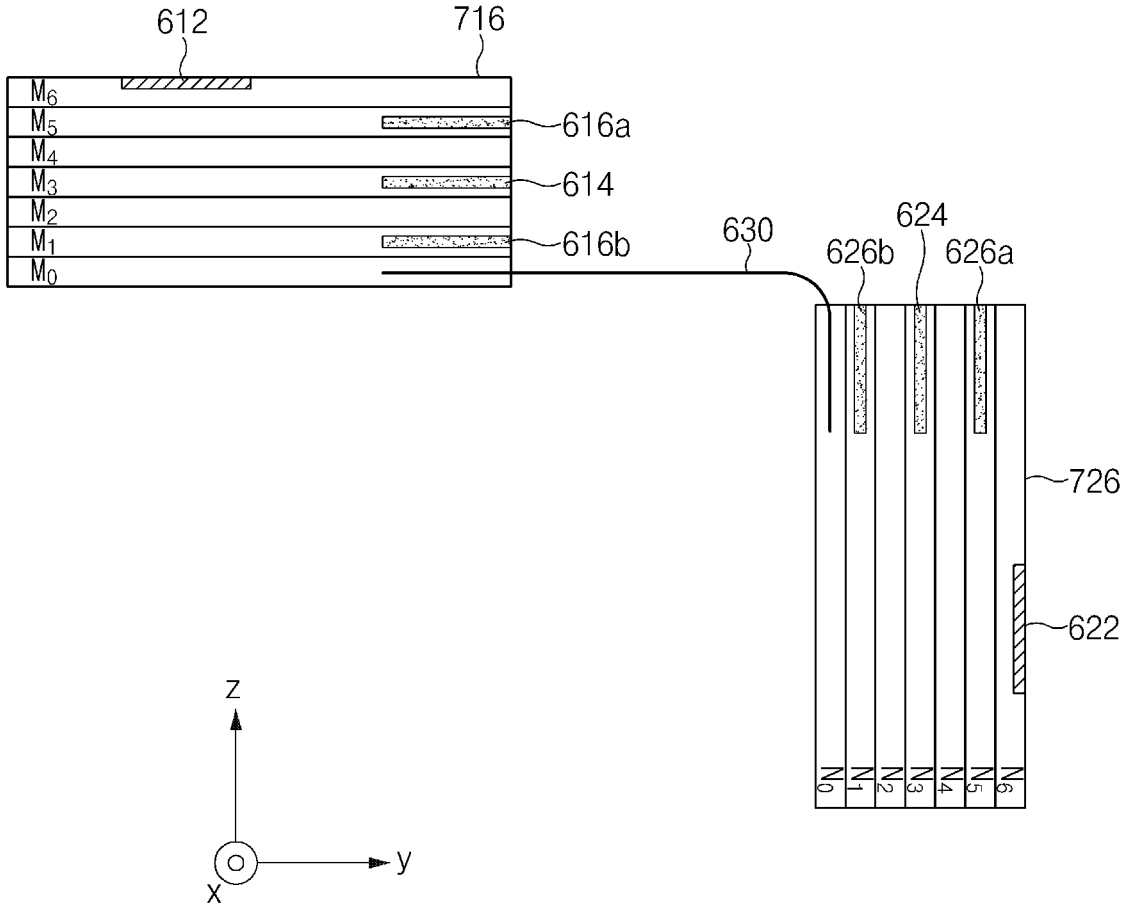
FIG. 8 illustrates an enlarged view of a structure in which a first communication device and a second communication device are connected, according to certain embodiments.

FIG. 8 illustrates an enlarged view of a structure in which the first conductive plate 610 and the second conductive plate 620 are connected, according to certain embodiments.

Referring to FIG. 8, the first PCB 716 may be composed of a plurality of first layers M0, M1 . . . M6, and the second PCB 726 may be composed of a plurality of second layers N0, N1 . . . N6. The number and arrangement of first layers and the number and arrangement of second layers are not limited to an example illustrated in FIG. 8. For example, the number and arrangement of first layers may be identical to the number and arrangement of second layers or may be at least partially different from the number and arrangement of second layers.

According to an embodiment, each of the first antenna arrays 612 and 622 may be positioned in the uppermost layer of layers. For example, in a three-dimensional coordinate system, the first antenna array 612 may be positioned in a layer (e.g., the first layer M6) having the greatest z-value, and the first antenna array 622 may be positioned in a layer (e.g., the second layer N6) having the greatest y-value. As the first antenna arrays 612 and 622 are respectively positioned in the uppermost layers, interference between signals radiated from the first antenna arrays 612 and 622 may be minimized. According to an embodiment, the third antenna elements 616*a* and 616*b* or 626*a* and 626*b* constituting the third antenna array 616 or 626 may be respectively positioned in upper and lower layers of the second antenna array 614 or 624.

According to an embodiment, the interface 630 may be connected with the lowermost layer of the first PCB 716 and the lowermost layer of the second PCB 726. For example, in a three-dimensional coordinate system, the interface 630 may be connected to a layer (e.g., the first layer M0) having the smallest z-value among the layers of the first PCB 716 and a layer (e.g., the second layer N0) having the smallest y-value among the layers of the second PCB 726. The interface 630 may be extended from the lowermost layers to connect the first conductive plate 610 and the second conductive plate 620, thus minimizing interference between signals radiated from the first antenna arrays 612 and 622, the second antenna arrays 614 and 624, and the third antenna arrays 616 and 626.

As described above, an electronic device (e.g., 101) may include a housing (e.g., 210 or 310) that forms an exterior of the electronic device and includes a front surface, a back surface (e.g., 701) facing away from the front surface, and a side surface (e.g., 702) at least partially surrounding a space between the front surface and the back surface, a first conductive plate (e.g., 610) that is positioned toward the back surface within the housing, and a second conductive plate (e.g., 620) that is positioned toward the side surface within the housing. The first conductive plate may include a first antenna array (e.g., 612) that radiates a signal in a first frequency band toward the back surface, and a second antenna array (e.g., 614) that radiates a signal in a second frequency band at least partially different from the first frequency band toward the side surface and has an antenna element at least partially different from the first antenna array. The second conductive plate may include a third antenna array (e.g., 622) that radiates the signal in the second frequency band toward the side surface, and a fourth antenna array (e.g., 624) that radiates the signal in the first frequency band toward the back surface.

According to an embodiment, the first conductive plate may include a first PCB (e.g., 716), the second conductive plate may include a second PCB (e.g., 726), and the electronic device may further include a coaxial cable or a FPCB (e.g., 630) connecting the first conductive plate and the second conductive plate.

According to an embodiment, each of the first PCB and the second PCB are composed of a plurality of layers (e.g., M0, M1 . . . M6 or N0, N1 . . . N6), and the FPCB may be assigned to one of the plurality of layers constituting the first PCB and one of the plurality of layers constituting the second PCB.

According to an embodiment, the first conductive plate may further include a first communication circuit (e.g., 718 of FIG. 7A) supporting the first frequency band, the second conductive plate may further include a second communication circuit (e.g., 728 of FIG. 7A) supporting the second frequency band, the first communication circuit may transmit the signal in the first frequency band to the second conductive plate through the coaxial cable or the FPCB, and the second communication circuit may transmit the signal in the second frequency band to the first conductive plate through the coaxial cable or the FPCB.

According to an embodiment, the first conductive plate may further include a third communication circuit (e.g., 718 of FIG. 7B) supporting the signal in the first frequency band and the signal in the second frequency band, and the third communication circuit may transmit the signal in the first frequency band or the signal in the second frequency band to the second conductive plate through the coaxial cable or the FPCB.

According to an embodiment, the first frequency band and the second frequency band may have a frequency between 20 GHz and 100 GHz.

According to an embodiment, the first antenna array may include at least one patch antenna, and the second antenna array may include at least one dipole antenna.

According to an embodiment, the first PCB and the second PCB may form one module.

As described above, an electronic device (e.g., 101) may include a housing (e.g., 210 or 310) that includes a first plate (not illustrated) forming at least a portion of a front surface of the electronic device, a second plate (e.g., 701) facing away from the first plate and forms at least a portion of a back surface of the electronic device, and a side member (e.g., 702) that at least partially surrounds a space between the first plate and the second plate, a display (e.g., 760) that is positioned within the housing and is visually exposed outside the electronic device through a portion of the first plate, an antenna structure (e.g., 600) that is positioned within the housing, and at least one wireless communication circuit (e.g., 340, 350, or 430). The antenna structure may include a first conductive plate (e.g., 610) facing a first direction which faces the second plate, and a second conductive plate (e.g., 620) facing a second direction of the side member while electrically connected to the first conductive plate. The first conductive plate may include at least one first conductive plate (e.g., 612) formed on or in the first conductive plate, and at least one first dipole antenna (e.g., 614) formed in or on the first conductive plate between the first conductive plate and a first portion of the side member, when viewed from above the second plate, and the second conductive plate may include at least one second conductive plate (e.g., 622) formed on or in the second conductive plate, and at least one second dipole antenna (e.g., 624) formed in or on the second conductive plate between the second conductive plate and the second plate, when viewed from above the side member. The at least one wireless communication circuit may be electrically connected with the first conductive plate, the first dipole antenna, the second conductive plate, and the second dipole antenna, and may transmit/receive a signal having a frequency between 3 GHz and 100 GHz.

According to an embodiment, the first conductive plate may include a first PCB (e.g., 716), and the second conductive plate may include a second PCB (e.g., 726).

According to an embodiment, the electronic device may further include a third PCB (e.g., 730) that is parallel to the first conductive plate and is placed between the display and the second plate.

According to an embodiment, a first portion (e.g., 718) of the wireless communication circuit may be mounted on the first PCB, a second portion (e.g., 728) of the wireless communication circuit may be mounted on the second PCB, and a third portion (e.g., 738) of the wireless communication circuit may be electrically connected with the first portion and the second portion and may be mounted on the third PCB.

According to an embodiment, the first portion of the wireless communication circuit may include a first signal path (not illustrated) electrically connected with the first conductive plate and a second signal path (not illustrated) electrically connected with the second dipole antenna.

According to an embodiment, the second portion of the wireless communication circuit may include a third signal path (not illustrated) electrically connected with the second conductive plate and a fourth signal path (not illustrated) electrically connected with the first dipole antenna.

According to an embodiment, the first conductive plate may be substantially perpendicular to the second conductive plate.

As described above, an electronic device (e.g., 101) may include a housing (e.g., 210 or 310) that includes a front surface of the electronic device, a back surface (e.g., 701) facing away from the front surface, and a side surface (e.g., 702) at least partially surrounding a space between the front surface and the back surface, a first conductive plate (e.g., 610) that is positioned on the back surface, a second conductive plate (e.g., 620) that is positioned on the side surface, and an interface (e.g., 630) that connects the first conductive plate and the second conductive plate. The first conductive plate may include a first communication circuit (e.g., 718) that transmits a signal in a first frequency band, a first antenna array (e.g., 612) that radiates the signal in the first frequency band toward the back surface, and a second antenna array (e.g., 614) that radiates a signal in a second frequency band at least partially different from the first frequency band toward the side surface and has an antenna element at least partially different from the first antenna array, and the second conductive plate may include a second communication circuit (e.g., 728) that transmits the signal in the first frequency band, a third antenna array (e.g., 622) that radiates the signal in the second frequency band toward the side surface, and a fourth antenna array (e.g., 624) that radiates the signal in the first frequency band toward the back surface.

According to an embodiment, the first conductive plate may include a first PCB (e.g., 716), and the second conductive plate may include a second PCB (e.g., 726).

According to an embodiment, each of the first PCB and the second PCB are composed of a plurality of layers (e.g., M0, M1 . . . M6 or N0, N1 . . . N6), and the interface includes an FPCB and may be assigned to one of the plurality of layers constituting the first PCB and one of the plurality of layers constituting the second PCB.

According to an embodiment, the first frequency band and the second frequency band may have a frequency between 20 GHz and 100 GHz.

According to an embodiment, the first antenna array may include a patch antenna, and the second antenna array may include a dipole antenna.

The electronic device according to certain embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that certain embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Certain embodiments as set forth herein may be implemented as software (e.g., the program 140) including one or more instructions that are stored in a storage medium (e.g., internal memory 136 or external memory 138) that is readable by a machine (e.g., the electronic device 101). For example, a processor (e.g., the processor 120) of the machine (e.g., the electronic device 101) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to certain embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to certain embodiments, each component (e.g., a module or a program) of the above-described components may include a single entity or multiple entities. According to certain embodiments, one or more of the above-described components may be omitted, or one or more other components may be added. Alternatively or additionally, a plurality of components (e.g., modules or programs) may be integrated into a single component. In such a case, according to certain embodiments, the integrated component may still perform one or more functions of each of the plurality of components in the same or similar manner as they are performed by a corresponding one of the plurality of components before the integration. According to certain embodiments, operations performed by the module, the program, or another component may be carried out sequentially, in parallel, repeatedly, or heuristically, or one or more of the operations may be executed in a different order or omitted, or one or more other operations may be added.

While the present disclosure has been shown and described with reference to certain embodiments thereof, it will be understood by those skilled in the art that various changes in form and details may be made therein without departing from the spirit and scope of the present disclosure as defined by the appended claims and their equivalents.

According to certain embodiments of the present disclosure, an electronic device may prevent a decrease in a mounting space of the electronic device by arranging a plurality of communication devices on a plurality of sides.

According to certain embodiments of the present disclosure, the electronic device may improve an antenna gain by radiating signals through antennas positioned on different sides.

Besides, a variety of effects directly or indirectly understood through this disclosure may be provided.

Other aspects, advantages, and salient features of the disclosure will become apparent to those skilled in the art from the following detailed description, which, taken in conjunction with the annexed drawings, discloses certain embodiments of the present disclosure.

What is claimed is:

1. An electronic device comprising:

a housing forming an exterior of the electronic device, and including a front surface, a back surface facing away from the front surface, and a side surface substantially perpendicular to the front surface and the back surface;

a first conductive plate positioned towards the back surface having a first antenna array disposed on the first conductive plate, the first antenna array configured to radiate a signal in a first frequency band toward the back surface;

a second antenna array connected to the first conductive plate, the second antenna array configured to radiate a signal in a second frequency band at least partially different from the first frequency band toward the side surface, and having an antenna element at least partially different from the first antenna array;

a second conductive plate positioned towards the side surface having a third antenna array disposed on the second conductive plate, the third antenna array configured to radiate the signal in the second frequency band toward the side surface; and a fourth antenna array connected to the second conductive plate and configured to radiate the signal in the first frequency band toward the back surface.

2. The electronic device of claim 1, wherein the first conductive plate includes a first printed circuit board (PCB), and wherein the second conductive plate includes a second PCB, the electronic device further comprising:

a coaxial cable or a flexible printed circuit board (FPCB) connecting the first conductive plate and the second conductive plate.

3. The electronic device of claim 2, wherein the first PCB comprises a first plurality of layers and the second PCB comprises a second plurality of layers, and wherein the FPCB is connected to one of the first plurality of layers one of the second plurality of layers.

4. The electronic device of claim 2, further comprising:

a first radio frequency integrated circuit (RFIC) supporting the first frequency band, disposed on the first conductive plate;

a second RFIC supporting the second frequency band, disposed on the second conductive plate, wherein the first RFIC is configured to transmit the signal in the first frequency band to the second conductive plate through the coaxial cable or the FPCB, and wherein the second RFIC is configured to transmit the signal in the second frequency band to the first conductive plate through the coaxial cable or the FPCB.

5. The electronic device of claim 2, further comprising a third RFIC supporting the signal in the first frequency band and the signal in the second frequency band disposed on the first conductive plate, and wherein the third RFIC is configured to transmit the signal in the first frequency band or the signal in the second frequency band to the second conductive plate through the coaxial cable or the FPCB.

6. The electronic device of claim 1, wherein the first frequency band and the second frequency band have a frequency between 20 GHz and 100 GHz.

7. The electronic device of claim 1, wherein the first antenna array includes at least one patch antenna, and wherein the second antenna array includes at least one dipole antenna.

8. The electronic device of claim 1, wherein the first conductive plate and the second conductive plate are configured to form one module.

9. An electronic device comprising:

a housing including a first plate forming at least a portion of a front surface of the electronic device, a second plate facing away from the first plate and forming at least a portion of a back surface of the electronic device, and a side member at least partially surrounding a space between the first plate and the second plate;

a display positioned within the housing, and visually exposed outside the electronic device through a portion of the first plate;

an antenna structure positioned within the housing, wherein the antenna structure includes:

at least one first conductive plate facing a first direction, the first direction facing the second plate, and at least one first dipole formed between the first conductive plate and a first portion of the side member, when viewed from above the second plate;

at least one second conductive plate facing a second direction, the second direction facing the side member, while electrically connected to the at least one first conductive plate, at least one second dipole antenna formed between the second conductive plate and the second plate, when viewed from above the side member, and at least one radio frequency integrated circuit (RFIC) electrically connected with the at least one first conductive plate, the at least one first dipole antenna, the at least one second conductive plate, and the at least one second dipole antenna, and configured to transmit/receive a signal having a frequency between 3 GHz and 100 GHz.

10. The electronic device of claim 9, wherein the at least one first conductive plate includes a first PCB, and wherein the at least one second conductive plate includes a second PCB.

11. The electronic device of claim 10, further comprising:

a third PCB parallel to the first PCB and disposed between the display and the second plate.

12. The electronic device of claim 11, wherein a first portion of the RFIC is mounted on the first PCB, wherein a second portion of the RFIC is mounted on the second PCB, and wherein a third portion of the RFIC is electrically connected with the first portion and the second portion and is mounted on the third PCB.

13. The electronic device of claim 12, wherein the first portion of the RFIC includes a first signal path electrically connected with the at least one first conductive plate and a second signal path electrically connected with the second dipole antenna.

14. The electronic device of claim 13, wherein the second portion of the RFIC includes a third signal path electrically connected with the second conductive plate and a fourth signal path electrically connected with the first dipole antenna.

15. The electronic device of claim 9, wherein the at least one first conductive plate is substantially perpendicular to the at least one second conductive plate.

16. An electronic device comprising:

a housing including a front surface of the electronic device, a back surface facing away from the front surface, and a side surface at least partially surrounding a space between the front surface and the back surface;

a first conductive plate positioned on the back surface;

a second conductive plate positioned on the side surface;

an interface connecting the first conductive plate and the second conductive plate;

a first RFIC disposed on the first conductive plate and configured to transmit a signal in a first frequency band;

a first antenna array disposed on the first conductive plate and configured to radiate the signal in the first frequency band toward the back surface;

a second antenna array connected to the first conductive plate and configured to radiate a signal in a second frequency band at least partially different from the first frequency band toward the side surface, and having an antenna element at least partially different from the first antenna array;

a second RFIC disposed on the second conductive plate and configured to transmit the signal in the first frequency band;

a third antenna array disposed on the second conductive plate and configured to radiate the signal in the second frequency band toward the side surface; and a fourth antenna array connected to the second conductive plate and configured to radiate the signal in the first frequency band toward the back surface.

17. The electronic device of claim 16, wherein the first conductive plate includes a first PCB, and wherein the second conductive plate includes a second PCB.

18. The electronic device of claim 17, wherein each of the first PCB and the second PCB are composed of a plurality of layers, and wherein the interface includes an FPCB and is connected to one of the plurality of layers of the first PCB and one of the plurality of layers of the second PCB.

19. The electronic device of claim 16, wherein the first frequency band and the second frequency band have a frequency between 20 GHz and 100 GHz.

20. The electronic device of claim 16, wherein the first antenna array includes a patch antenna, and wherein the second antenna array includes a dipole antenna.

* * * * *